US005609088A

United States Patent [19]

Park

[11] Patent Number: 5,609,088

[45] Date of Patent: Mar. 11, 1997

[54] HYDRAULIC CONTROL SYSTEM FOR EXCAVATIONS WITH AN IMPROVED FLOW CONTROL VALVE

[75] Inventor: Hee W. Park, Seoul, Rep. of Korea

[73] Assignee: Daewoo Heavy Industries, Ltd., Incheon, Rep. of Korea

[21] Appl. No.: 506,792

[22] Filed: Jul. 25, 1995

[30] Foreign Application Priority Data

Jul. 25, 1994 [KR] Rep. of Korea ..... 94-18017

[51] Int. Cl.[6] ..... F15B 11/10

[52] U.S. Cl. ..... 91/420; 91/421; 91/433; 91/518

[58] Field of Search ..... 91/420, 433, 446, 91/447, 518, 532

[56] References Cited

U.S. PATENT DOCUMENTS

| | | | |
|---|---|---|---|
| 4,041,983 | 8/1977 | Bianchetta | 91/433 |
| 4,425,759 | 1/1984 | Krusche | 60/420 |
| 4,938,023 | 7/1990 | Yoshino . | |
| 5,138,837 | 8/1992 | Obertrifter et al. | 91/446 |
| 5,477,678 | 12/1995 | Shirai et al. | 91/517 |

*Primary Examiner*—F. Daniel Lopez
*Attorney, Agent, or Firm*—Lowe, Price, LeBlanc & Becker

[57] ABSTRACT

A hydraulic control system for excavators includes a variable displacement pump for producing a variable volume of pressurized working fluid, a hydraulic swing motor rotatably driven by the working fluid and a flow control valve operable to control flow of the working fluid with respect to the swing motor. The first flow control valve comprises a valve body and a valve spool slidably fitted into the valve body for selective shifting movement between a first operative position, a second operative position and a neutral position. The valve body has first and second control pressure chambers arranged at opposite ends thereof in an opposing relationship with each other, the first control pressure chamber adapted to receive a part of the working fluid headed for the swing motor to urge the valve spool toward the second operative position in response to the shifting movement of the valve spool into the first operative position, the second control pressure chamber adapted to receive a part of the working fluid headed for the swing motor to bias the valve spool toward the first operative position in response to the shifting movement of the valve spool into the second operative position.

7 Claims, 5 Drawing Sheets

HYDRAULIC CONTROL SYSTEM FOR EXCAVATIONS WITH AN IMPROVED FLOW CONTROL VALVE

FIELD OF THE INVENTION

The present invention pertains to a hydraulic control system for use in industrial vehicles and, more specifically, to a hydraulic control system capable of effectively controlling the combined actuation of a hydraulic boom cylinder and a hydraulic swing motor with which excavators or mobile diggers are equipped among other components.

DESCRIPTION OF THE PRIOR ART

As is known to those skilled in the art, conventional excavators include a moving undercarriage, an upper swing frame mounted pivotally on the undercarriage for horizontal turning movement thereabout, a boom held in front of the upper swing frame for vertical angular movement within a limited extent and a bucket pivotally carried on the distal end of the boom by way of an interconnecting arm. The upper swing frame may be caused to swing by a hydraulic swing motor and the boom may be subjected to pivotal movement on a vertical plane in response to the extension or retraction of a hydraulic boom cylinder. The pivotal movement of the bucket is effectuated in a similar way by its own hydraulic cylinder. Actuation of the swing motor, the boom cylinder and the bucket cylinder can be properly controlled through the use of a hydraulic control system to thereby enable the excavators to carry out digging, excavating and other like tasks assigned thereto.

The hydraulic control system employed in the prior art excavators, however, has proven to pose at least two-fold drawbacks as further explained below. First of all, the fluid pressure in the swing motor is likely to soar in the event that the upper swing frame is caused to turn with a strong torque against the load exerting thereon. This will adversely affect the fine operability of the excavator as a matter of course. Secondly, in case where the boom cylinder is actuated in synchronism with the swing motor, the fluid pressure in the swing motor tends to become unduly greater than the fluid pressure developed in the boom cylinder, with the result that the upper swing frame will turn at a far faster speed than the boom is lifted up. For avoidance of the above noted drawbacks, U.S. Pat. No. 4,938,023 to Yoshino on Jul. 3, 1990 discloses a fluid pressure control system comprising a first selector valve for controlling the action of a first actuator, a second selector valve for controlling the action of a second actuator, a first flow control valve for controlling flow of a fluid to be supplied to the first actuator, and a second flow control valve for controlling flow of a fluid to be supplied to the second actuator. A pressure reducing valve is provided for reducing the pressure of the fluid supplied to the second actuator. The pressure on the outlet side of the pressure reducing valve is controlled by a proportional pressure relief valve which is controlled by an external pilot pressure. The fluid pressure control system taught in the '023 patent offers significant advantages over the prior art system in that the turning speed of the upper swing frame can be controlled to match the ascending speed of the boom. Nevertheless, it is evident that a couple of shortcomings remain unsolved in accordance with the '023 patent. One disadvantage is that pressure loss may often occur at a swing motor side relief valve and a boom cylinder side pressure compensator valve due to the pressure surge developed in the swing motor during the process of starting up movement of the upper swing frame. As a result, the fluid pressure control system becomes unable to perform its task in an efficient manner and at a reduced energy consumption rate. Another disadvantage is the requirement of using additional valves to match the upper swing frame turning speed with the boom ascending speed, which in turn makes the fluid pressure control system hard-to-fabricate and costly.

SUMMARY OF THE INVENTION

It is an object of the invention to provide a hydraulic control system for excavators that can eliminate the deficiencies inherent in the prior art devices and further that can substantially avoid pressure loss in a fluid pressure circuitry to thereby reduce energy consumption, while assuring an improved fine operability of the boom and the upper swing frame and maintaining the components of the hydraulic control system as small a number as possible.

With the object in view, the invention provides a hydraulic control system for excavators of the type including a variable displacement pump for producing a variable volume of pressurized working fluid, a hydraulic swing motor rotatably driven by the working fluid and a flow control valve operable to control flow of the working fluid with respect to the swing motor, characterized in that the first flow control valve comprises a valve body and a valve spool slidably fitted into the valve body for selective shifting movement between a first operative position, a second operative position and a neutral position, the valve body having first and second control pressure chambers arranged at opposite ends thereof in an opposing relationship with each other, the first control pressure chamber adapted to receive a part of the working fluid headed for the swing motor to urge the valve spool toward the second operative position in response to the shifting movement of the valve spool into the first operative position, the second control pressure chamber adapted to receive a part of the working fluid headed for the swing motor to bias the valve spool toward the first operative position in response to the shifting movement of the valve spool into the second operative position.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
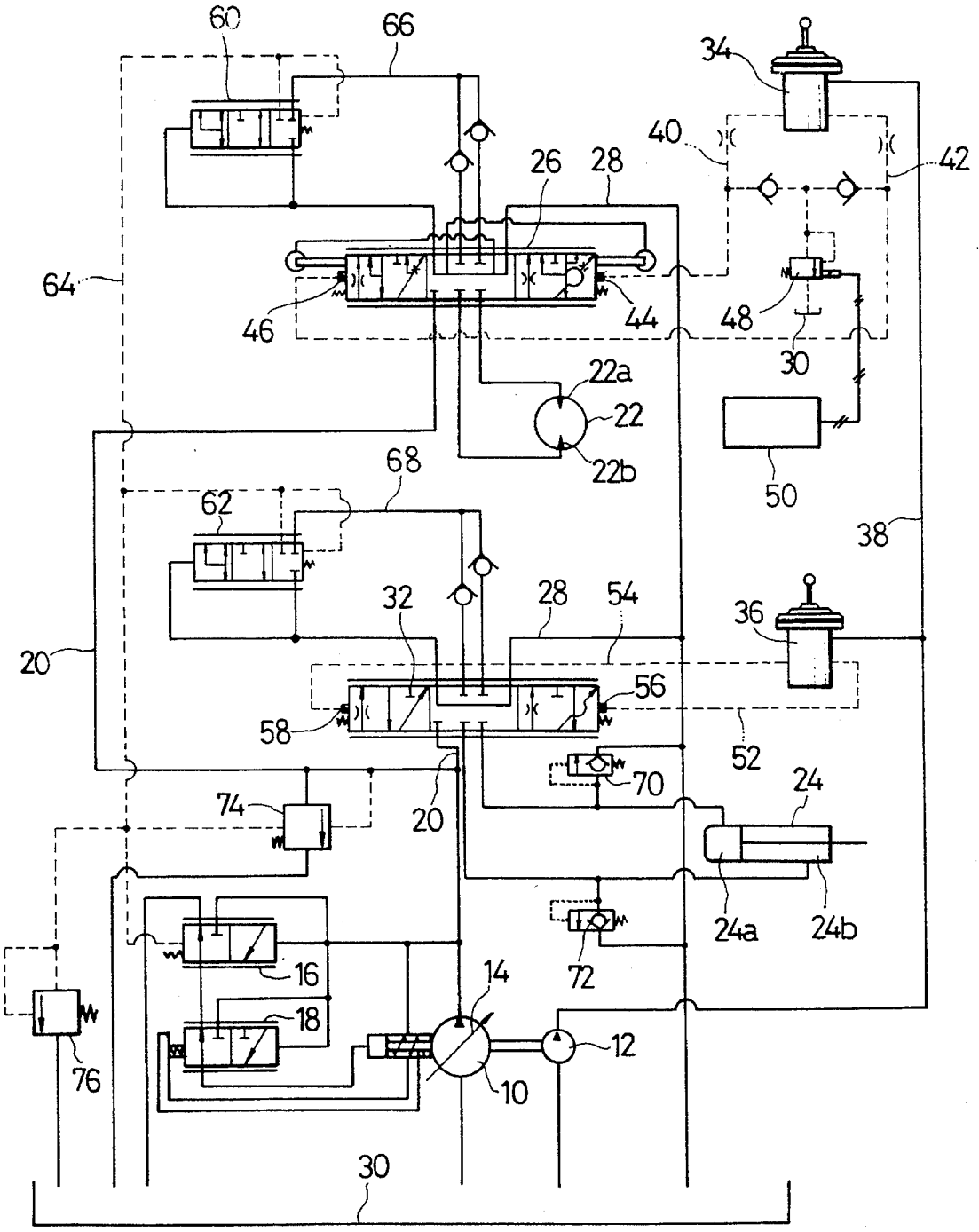
FIG. 1 is a fluid pressure circuit diagram showing the hydraulic control system for excavators in accordance with the invention.

Referring now to FIG. 1, the hydraulic control system embodying the present invention comprises a variable displacement pump 10 for the production of high pressure working fluid and an auxiliary pump 12 creating low pressure pilot fluid, both of which are driven by a prime mover not shown in the drawings for simplicity. The variable displacement pump 10 is typically provided with a swash plate 14 that serves to alter the discharge volume of the working fluid depending on the inclination angle thereof. The inclination angle of the swash plate 14 is controlled by means of a load sensing valve 16 and a horsepower control valve 18. It should be understood that the discharge volume of the working fluid fluctuates in proportion to the swash plate inclination angle, namely, the greater the inclination angle grows, the more working fluid the variable displacement pump discharges.

The working fluid produced by the pump 10 is delivered to a hydraulically operated swing motor 22 and a hydraulic boom cylinder 24 by way of a main supply line 20. The swing motor 22 is used to turn a upper swing frame (not shown) of the excavator in a forward or reverse direction and has first and second fluid communication holes 22*a*, 22*b* through which the working fluid flows into or out of the swing motor 22. Meanwhile, the boom cylinder 24 is adapted to raise or lower a boom (not shown) of the excavator and has first and second pressure chambers 24*a*, 24*b* which are fed with the working fluid to cause extension and retraction of the boom cylinder 24.

A first flow control valve 26 can be utilized in controlling flow of the working fluid to and from the swing motor 22. The first flow control valve 26 is position-controlled by virtue of a pilot unit set forth later such that the working fluid can be either admitted into or prohibited from entering the swing motor 22 via one of the fluid communication holes 22*a*, 22*b*. The working fluid exhausted from the swing motor 22 goes to a fluid reservoir 30 by way of a drain line 28. Description for further details of the first flow control valve 26 will be offered later in conjunction with FIG. 2.

A second flow control valve 32 is made use of to control delivery of the working fluid either between the pump 10 and the boom cylinder 24 or between the boom cylinder 24 and the fluid reservoir 30. As with the first flow control valve 26 set out above, the second valve 32 is position-controlled by virtue of a pilot unit to effectuate extension and retraction of the boom cylinder 24. The working fluid exhausted from the boom cylinder 24 goes to the fluid reservoir 30 via the drain line 28.

The pilot unit for position-controlling the first and second flow control valves 26, 32 includes, inter alia, a first joy stick 34 and a second joy stick 36, both of which can be subjected to manual pivotal movement by the driver. The first joy stick 34 is connected to the auxiliary pump 12 via a pilot fluid supply line 38 and serves, depending on its pivot angle, to cause the pilot fluid to be delivered to either of first and second pilot pressure chambers 44, 46 through first and second control lines 40, 42. It can be noted that the pilot chambers 44, 46 are provided at opposite ends of the first flow control valve 26. In the event that the pilot fluid should be fed to the first pilot chamber 44, the first flow control valve 26 will move to the left. To the contrary, introduction of the pilot fluid into the second pilot chamber 46 will cause the first flow control valve 26 to move rightwise. In case where the fluid pressure within the first and second control lines 40, 42 exceeds a preselected upper limit, the pilot fluid is partially leaked from the control lines 40, 42 by the action of an electronic proportional relief valve 48 and then returned to the fluid reservoir 30. An electronic controller 50 may be used to preset the upper limit of the fluid pressure at which the pilot fluid begins to leak through the relief valve 48.

The second joy stick 36 is also connected to the auxiliary pump 12 via the pilot fluid supply line 38 and serves, depending on its pivot angle, to cause the pilot fluid to be fed to either of third and fourth pilot pressure chambers 56, 58 through third and fourth control lines 52, 54. It can be seen that the third and fourth pilot chambers 56, 58 are arranged at opposite ends of the second flow control valve 32. Supplying the pilot fluid to the third pilot chamber 56 will result in a leftward movement of the second flow control valve 32, whereas admission of the pilot fluid into the fourth pilot chamber 58 will lead to a rightward displacement of the second flow control valve 32.

A first pressure compensator valve 60 lies downstream of the first flow control valve 26 for fluid communication therewith, with a second pressure compensator valve 62 placed downstream of the second flow control valve 32 in a similar way. The first pressure compensator valve 60 is in fluid communication with the second pressure compensator valve 62 via a load sensing line 64 which in turn lead to the load sensing valve 16. At the time when the load pressure developed in the swing motor 22 is less than the load pressure induced at the boom cylinder 24, the first pressure compensator valve 60 will be shifted to throttle a first connection line 66 that interconnects the first flow control valve 26 and the swing motor 22, thereby reducing the quantity of the working fluid to be fed to the swing motor 22. In case of the load pressure in the swing motor 22 being greater than that of the boom cylinder 24, the first pressure compensator valve 60 will leave the first connection line 66 unthrottled, thus allowing a large quantity of the working fluid to enter the swing motor 22. In this case, the load sensing line 64 comes into fluid communication with the first connection line 66 to receive the load pressure from the swing motor 22.

Likewise, as long as the load pressure acting on the boom cylinder 24 remains less than the load pressure of the swing motor 22, the second pressure compensator valve 62 will continue to throttle a second connection line 66 that interconnects the second flow control valve 32 and the boom cylinder 24, thereby reducing the quantity of the working fluid to be supplied to the boom cylinder 24. Conversely, should the load pressure acting on the boom cylinder 24 grow larger than the load pressure of the swing motor 22, the second pressure compensator valve 62 will no longer throttle the second connection line 68, which would enable a great quantity of the working fluid to be delivered to the boom cylinder 24. At that time, the load sensing line 64 is brought into fluid communication with the second connection line 68 to take in the load pressure of the boom cylinder 24.

For the very reason stated above, the fluid pressure in the load sensing line 64 is equated with the load pressure acting on the swing motor 22 or the load pressure associated with the boom cylinder 24, whichever is greater than the other. The load sensing valve 16 set forth earlier is adapted to be position-controlled by the magnitude of pressure differential between the fluid pressure in the load sensing line 64 and the fluid pressure at the exit of the variable displacement pump 10, so that the fluid discharge volume can be properly regulated in response to the load pressure exerting on the swing motor 22 and the boom cylinder 24. Reference numerals 70, 72, 74, 76 in FIG. 1 denote conventional relief valves widely employed in the art of hydraulic control device.

Figure 2:
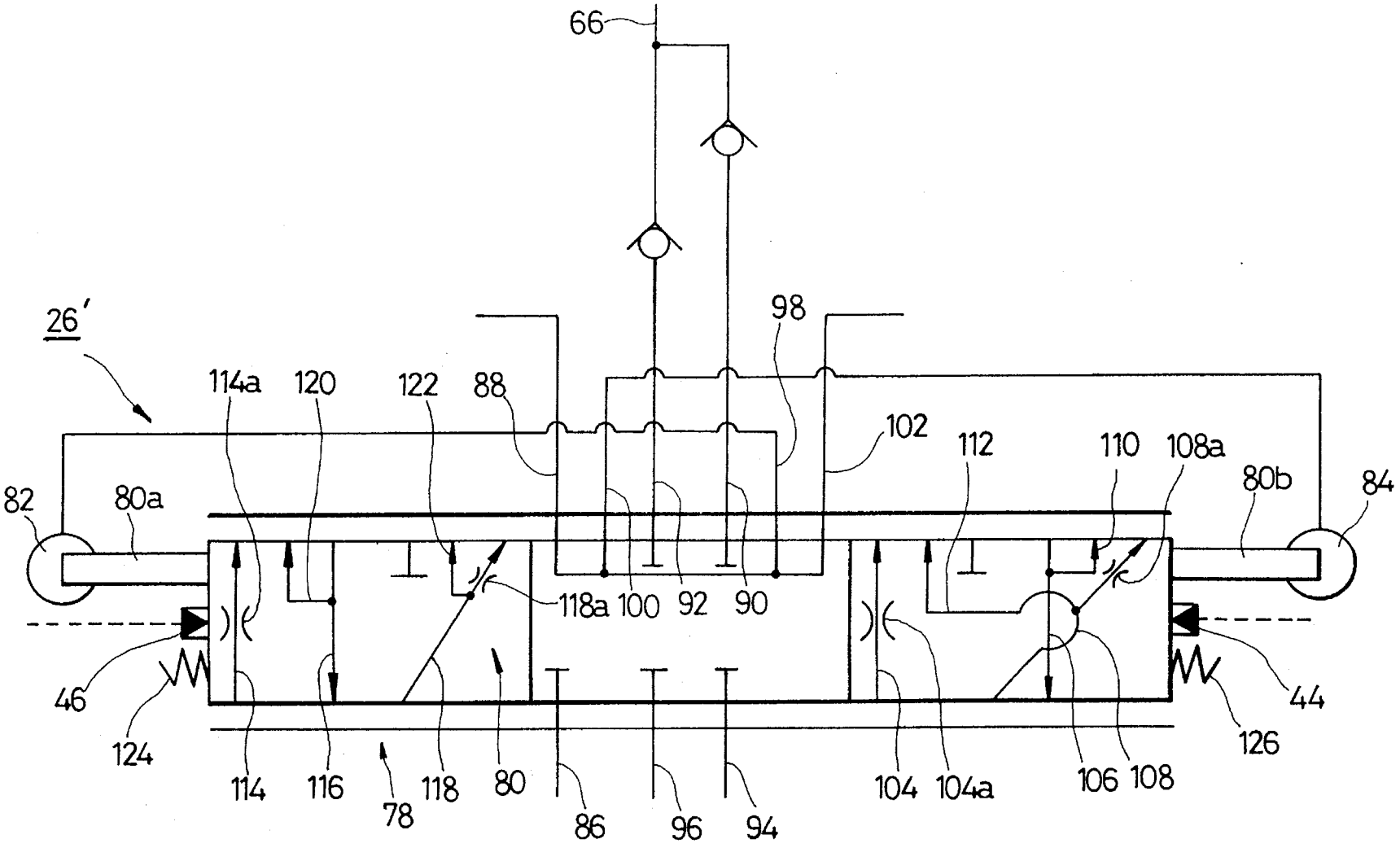
FIG. 2 illustrates a first embodiment of the flow control valve on an enlarged scale, with the valve spool in a neutral position.

Referring to FIG. 2, there is shown the first flow control valve 26 in accordance with the first embodiment of the invention on an enlarged scale. As shown, the first flow control valve 26 includes a valve body 78 and a valve spool 80 slidably fitted into the valve body 78. The valve spool 80 is shiftable to assume a first operative position, a second operative position and a neutral position, thus controlling the flow rate and the flow direction of the working fluid with respect to the swing motor 22. As discussed hereinabove, the direction in which the valve spool 80 is made to move depends on which pilot pressure chamber 44 or 46 would be supplied with the pilot fluid. The valve body 78 includes a first control pressure chamber 82 into which a part of the working fluid headed for the swing motor 22 can be introduced to apply a resistant force to the spool 80 as the latter moves toward the first operative position, i.e., leftwardly in FIG. 2, and a second control pressure chamber 84 into which a part of the working fluid headed for the swing motor 22 can be admitted to exert a retardant force on the spool 80 as the latter moves toward the second operative position, i.e., rightwardly in FIG. 2. In addition, the valve body 78 is provided with an inlet port 86 leading to the variable displacement pump 10, an outlet port 88 in an alignment with the inlet port 86 and leading to the first pressure compensator valve 60, first and second supply port 90, 92 connected in common to the outlet port 88 by way of the first pressure compensator valve 60, first and second actuation ports 94, 96 each in an alignment with the supply ports 90, 92 and leading to the first and second fluid communication holes 22*a*, 22*b* of the swing motor 22, first and second control ports 98, 100 each leading to the first and second control pressure chambers 82, 84 and a drain port 102 communicating with the fluid reservoir 30.

As clearly shown in FIG. 2, the valve spool 80 includes a first control spool 80*a* extending from a first end of the valve spool 80 into the first control chamber 82 and a second control spool 80*b* protruding from a second end of the valve spool 80 into the second control chamber 84. Defined across the fight-side extension of the valve spool 80 are a first upstream channel 104 which serves to selectively interconnect the inlet port 86 and the outlet port 88, a first downstream channel 106 providing selective fluid communication between the first supply port 90 and the first actuation port 94, a first main drainage channel 108 that selectively brings the second actuation port 96 into communication with the drain port 102, a first control fluid inlet channel 110 branched off from the first downstream channel 106 so as to come into selective communication with the first control port 98 and a first control fluid outlet channel 112 branched off from the first main drainage channel 108 for selective communication with the second control port 100, all of these first channels 104, 106, 108, 110, 112 becoming active just when the valve spool 80 is in the first, leftmost, operative position.

In a similar manner, defined across the left-side extension of the valve spool 80 are a second upstream channel 114 which serves to selectively interconnect the inlet port 86 and the outlet port 88, a second downstream channel 116 providing selective fluid communication between the second supply port 92 and the second actuation port 96, a second main drainage channel 118 that selectively brings the first actuation port 94 into communication with the drain port 102, a second control fluid inlet channel 120 branched off from the second downstream channel 116 so as to come into selective communication with the second control port 100 and a second control fluid outlet channel 122 branched off from the second main drainage channel 118 for selective communication with the first control port 98, all of these second channels 114, 116, 118, 120, 122 being at work in case where the valve spool 80 has been shifted to the second, rightmost, operative position. It should be noted that first and second compression springs 124, 126 are retained at opposite ends of the valve spool 80 to bias the latter.

Somewhere along each of the first and second upstream channels 104, 114, first and second supply side throttle necks 104*a*, 114*a* are provided to restrict flow rate of the working fluid which is to be delivered to the swing motor 22 from the variable displacement pump 10. Similarly, first and second drain side throttle necks 108*a*, 118*a* are formed midway of the first and second main drainage channels 108, 118 to retard outflow of the working fluid from the swing motor 22 into the fluid reservoir 30.

In the first embodiment of the flow control valve 26 illustrated in FIG. 2, the first drain side throttle neck 108*a* is positioned in the vicinity of an outlet end of the first main drainage channel 108 such that, even when the second actuation port 96 is connected to the drain port 102 by the first main drainage channel 108, the working fluid in the swing motor 22 can leak dilatorily from the second fluid communication hole 22*b* toward the fluid reservoir 30. The result is that the working fluid exhausted from the swing motor 22 via the second actuation port 96 should be partially introduced into the second control pressure chamber 84 through the first control fluid outlet channel 112 and the second control port 100, thus urging the valve spool 80 in the leftward direction. The fluid pressure developed in the second control pressure chamber 84 will then decrease gradually over time as the working fluid is discharged through the first drain side throttle neck 108*a*.

Likewise, the second drain side throttle neck 118*a* lies adjacent to an outlet end of the second main drainage channel 118 to ensure that, even if the first actuation port 94 comes into connection to the drain port 102 by way of the second main drainage channel 118, the working fluid in the swing motor 22 should leak at a reduced speed from the first fluid communication hole 22*a* toward the fluid reservoir 30. As a result, the working fluid drawn out of the swing motor 22 via the first actuation port 96 will be partially admitted into the first control pressure chamber 82 through the second control fluid outlet channel 122 and the first control port 98, thereby biasing the valve spool 80 in the rightward direction. The fluid pressure developed in the first control pressure chamber 82 will then decrease gradually over time as the working fluid is discharged through the second drain side throttle neck 118*a*.

Figure 3:
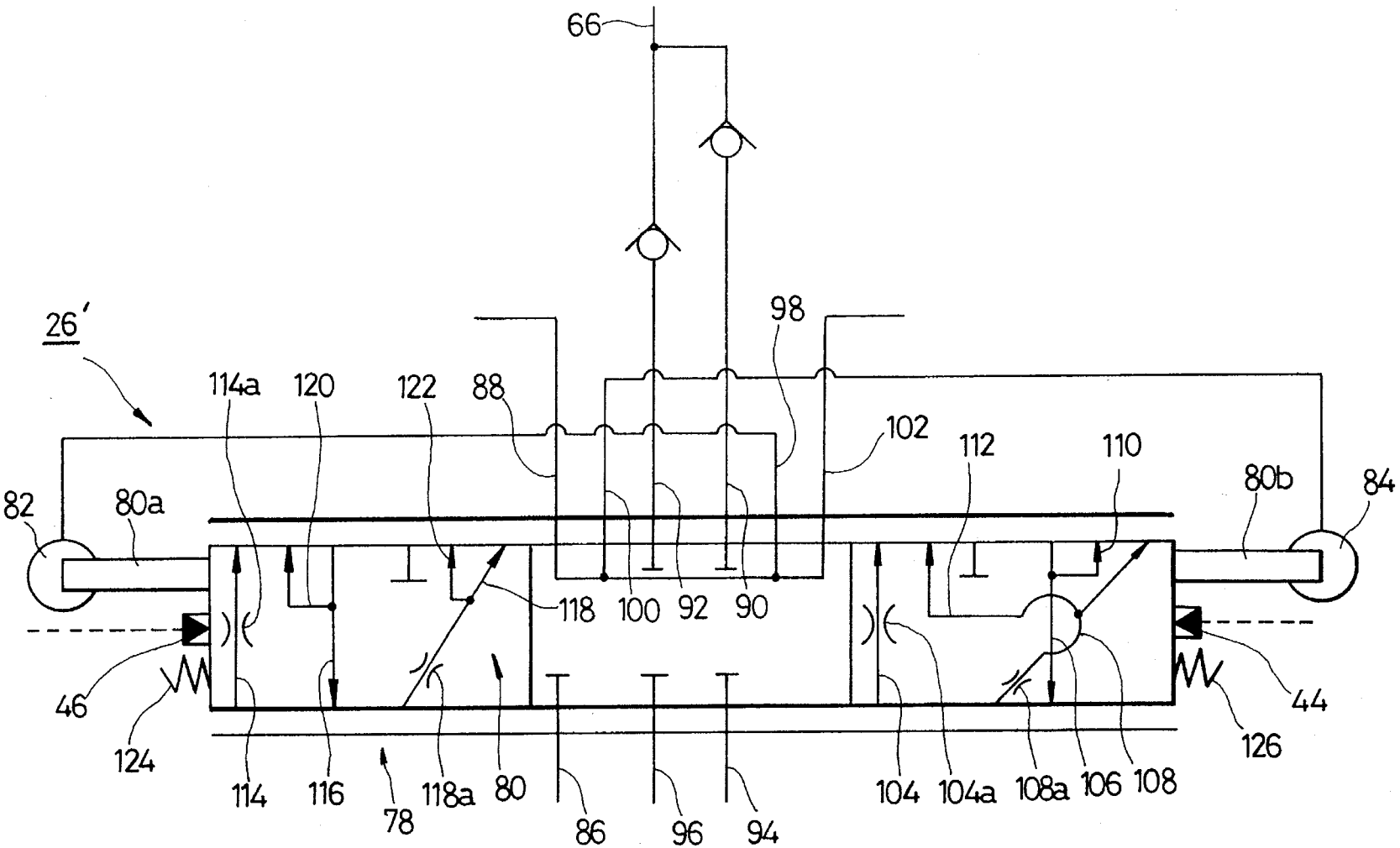
FIG. 3 is a view similar to FIG. 2 but showing a second embodiment of the flow control valve.
Figure 4:
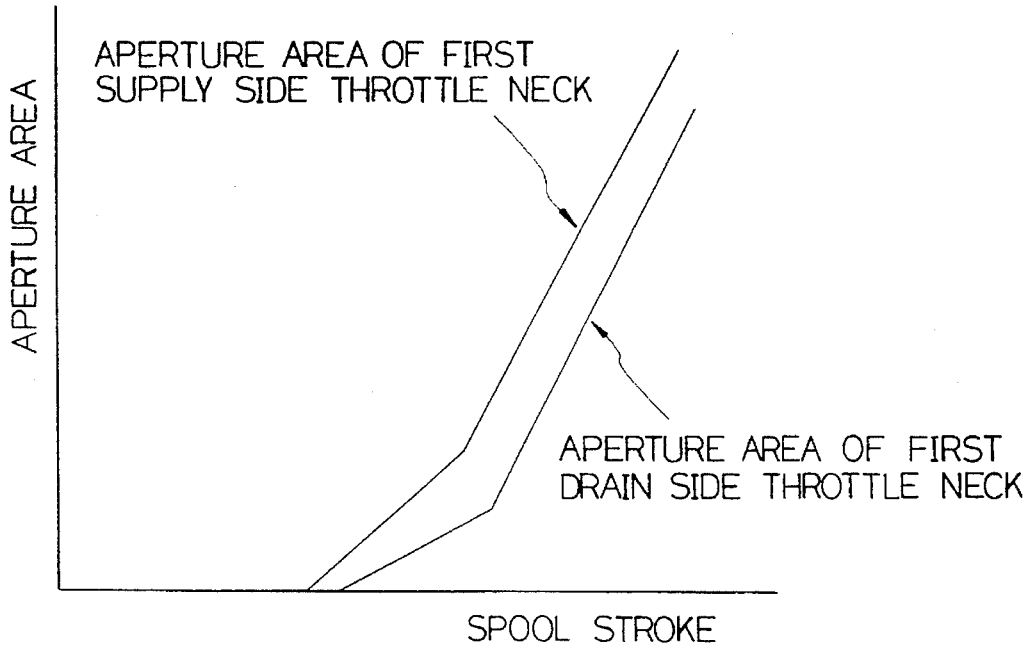
FIG. 4 graphically represents the correlation of spool stroke and aperture area for the flow control valve shown in FIG. 2.

FIG. 3 shows in greater detail the flow control valve 26' in accordance with the second embodiment of the invention. The flow control valve 26' has almost the same construction as the flow control valve 26 set forth above in conjunction with the first embodiment, with the exception that the first and second drain side throttle necks 108*a*, 118*a* are respectively positioned adjacent to inlet ends, rather than the outlet ends, of the first and second main drainage channels 108, 118. For the sake of convenience, like parts or components are designated by the same reference numerals as used in FIG. 2, without offering any detailed description with respect thereto. Positioning the first and second drain side throttle necks 108*a*, 118*a* close to the inlet ends of the channels 108, 118 in this way inhibits the working fluid under exhaustion from applying pressure to the first or second control pressure chamber 82 or 84. It is a matter of cause that the discharge of the working fluid from the swing motor 22 ia retarded, thanks to the throttle necks 108*a*, 118*a*.

Behavior or operation of the hydraulic control system embodying the invention will now be described with reference to FIGS. 1 through 6, with emphasis placed on the flow control valve 26.

As the pilot fluid is caused to enter the first pilot pressure chamber 44 in response to the pivoting action of the joy stick 34, the spool 80 of the first flow control valve 26 will move leftwardly in FIG. 2 against the first compression spring 124 to thereby assume the first operative position. This results in the working fluid being delivered from the variable displacement pump 10 to the swing motor 22 via the inlet port 86, the first upstream channel 104, the outlet port 88, the first connection line 66, the first supply port 90, the first downstream channel 106, the first actuation port 94 and the first communication hole 22*a* in the named sequence. At this moment, the working fluid will partially enter the first control pressure chamber 82 by way of the first control fluid inlet channel 110 and the first control port 98 to apply a thrust force on the first control spool 80*a*.

Concurrently, the working fluid exhausted from the swing motor 22 will reach the fluid reservoir 30 via the second communication hole 22*b*, the second actuation port 96, the first main drainage channel 108 and the drain port 102. Inasmuch as the first drain side throttle neck 108*a* lies adjacent to the outlet end of the first main drainage channel 108, the pressure of the working fluid flowing through the first main drainage channel 108 remains high for a while and, therefore, is transferred up to the second control pressure chamber 84 via the first control fluid outlet channel 112 and the second control port 100.

Specifically, the fluid pressure surge initially created in the swing motor 22 due to the inertia of the upper swing frame will be conveyed to the second control pressure chamber 84, which in turn causes the valve spool 80 to be urged rightwardly. This means that the leftward movement of the valve spool 80 is heavily restricted by the pressure in the swing motor 22. If the upper swing frame begins to move at an accelerated speed, then the pressure in the swing motor 22 and hence in the second control pressure chamber 84 will drop gently, allowing the valve spool 80 to further move in the left-hand direction in FIG. 2. In response, the aperture area of the first supply side throttle neck 104*a*, will increase in such a manner as to describe the curves shown in FIG. 4. Meanwhile, in case where the pilot pressure in the first pilot pressure chamber 44 is less than the biasing force of the first compression spring 124 plus the control pressure in the first control pressure chamber 82, it becomes impossible to increase the spool stroke, the aperture area of the throttle neck 104*a* and the fluid pressure in the swing motor 22. In other words, the acceleration of the swing motor 22 and hence the upper swing frame is determined by the pilot pressure in the chamber 44, which in turn depends on the pivoting angle of the first joy stick 34.

At the time when the first joy stick 34 is pivoted to such an angle as to reduce the swinging speed of the upper swing frame, a high fluid pressure will be developed at the second communication hole 22*b* of the swing motor 22, which pressure is then transferred to the second control pressure chamber 84 via the first control fluid outlet channel 112. Accordingly, the spool 80 of the flow control valve 26 is kept from coming back to the neutral position unless and until the fluid pressure in the first main drainage channel 108 would drop below a predetermined value. Once the spool 80 is brought into the neutral position, the working fluid in the first and second control pressure chambers 82, 84 will be drained to the fluid reservoir 30, with the result that no fluid pressure may grow up in the control pressure chambers 82, 84. This will help stabilize the flow control valve 26 at its neutral position, assuring that the upper swing frame be prohibited from an unwanted swinging movement by gravity, particularly when the excavator is performing its task on a sloping land.

For the purpose of the instant invention, the spool stroke S of the flow control valve 26 is given by the equation:

$$S=\frac{A}{k}\,Pi-\frac{a}{k}\,\Delta P-\delta$$

wherein "A" denotes the pilot pressure receiving area of the valve spool 80, "k" the spring constant of the compression spring 124 or 126, "Pi" the pilot pressure exerting within the pilot pressure chamber 44 or 46, "α" the control pressure receiving area of the control spool 80*a* or 80*b*, "ΔP" the effective pressure differential between entrance and exit of the swing motor 22 and "δ" the initial compression ratio of the compression spring 124 or 126.

Figure 5:
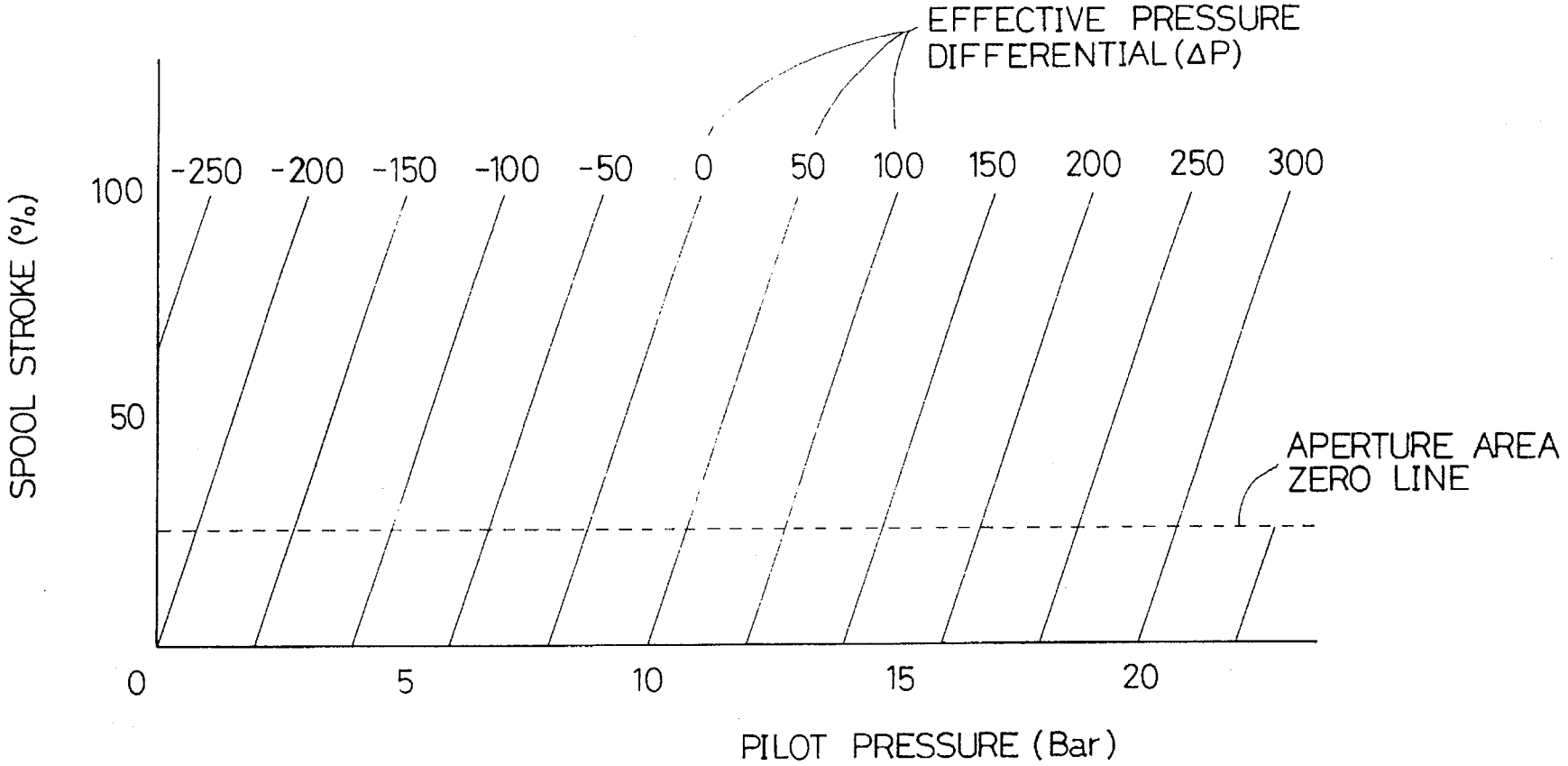
FIG. 5 is a graphical representation depicting the interrelation of pilot pressure and spool stroke in the flow control valve illustrated in FIG. 2.

FIG. 5 shows the correlation between spool stroke S and pilot pressure Pi which is plotted by use of the equation noted above. The skew lines indicate variation of spool stroke S with respect to pilot pressure Pi for a variety of effective pressure differentials ΔP. Furthermore, the negative symbol attached to the pressure differentials ΔP below zero is intended to mean that the fluid pressure at the exit of the swing motor 22 goes beyond the fluid pressure at the entrance thereof, as in case of decelerating the swing motor 22.

It can be seen in FIG. 5 that the fluid pressure for swing motor acceleration, i.e., the entrance pressure, becomes greater in response to the increase of pilot pressure Pi and that spool stroke S varies in direct proportion to the pilot pressure Pi but in reverse proportion to the effective pressure differential ΔP. The upper limit that the pilot pressure Pi is allowed to reach can be regulated with the use of the electronic proportional relief valve 48 and the electronic controller 50 (see FIG. 1). This enables the excavator operator to restrict the fluid pressure for acceleration of the swing motor 22 at his or her will, making it possible to reduce the relief pressure loss in the swing motor 22 as well as the throttle pressure loss in the boom cylinder 24, especially during the course of combined operation of the swing motor 22 and the boom cylinder 24.

Figure 6:
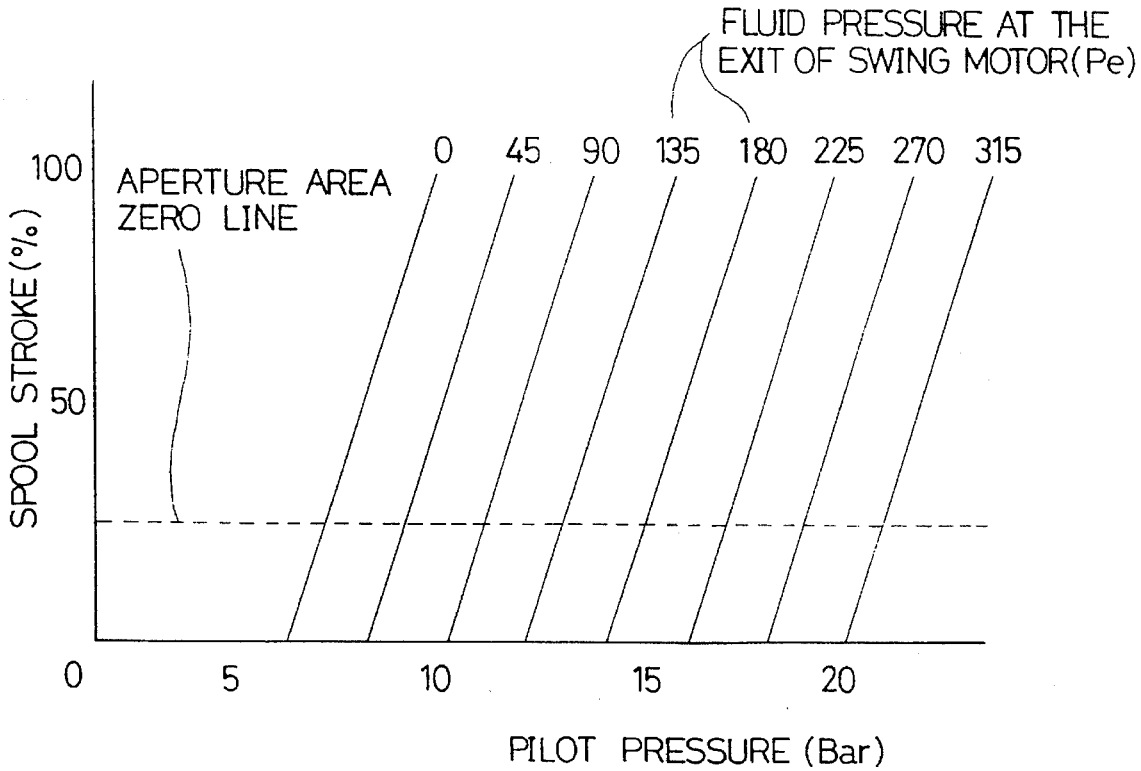
FIG. 6 shows the interrelation of pilot pressure and spool stroke in the flow control valve shown in FIG. 3.

With the flow control valve 26 shown in FIG. 2, the return behavior of the valve spool 80 into the neutral position may be delayed due to the pressure surge normally developed at the exit of the swing motor 22 as the latter is subjected to deceleration. This may make it somewhat difficult to stop the upper swing frame precisely at a desired angular position. Nor may it be easy to control the movement of the upper swing frame when the excavator is performing its task on a sloping land. Such a negative aspect of the first embodiment flow control valve 26 can be cleared away by using the flow control valve 26' of the second embodiment illustrated in FIG. 3 wherein the fluid pressure built up at the exit of the swing motor 22 is unable to propagate to the first and second control pressure chamber 82, 84. The characteristic feature of the flow control valve 26' in accordance with the second embodiment is shown in FIG. 6 in which the skew lines represent the variation of spool stroke S with respect to pilot pressure Pi for a number of selected entrance pressures $P_e$ of the swing motor 22.

As fully described above, the instant hydraulic control system for excavators enables the operator to control the fluid pressure for swing acceleration in an effortless and precise manner, making it possible to avoid any decrease in the boom lifting speed which would otherwise take place during the combined or simultaneous activation of the swing motor and the boom cylinder. This insures that the boom lifting speed can be properly matched to the swinging speed of the upper swing frame depending on the condition of works to be carried out by the excavator. Moreover, the inventive hydraulic control system help itself minimize the relief pressure loss on the side of the swing motor and the throttle pressure loss in the pressure compensator valve whereby significant energy saving can be achieved along with a considerable reduction of components or parts.

While the invention has been described with reference to a preferred embodiment, it should be apparent to those skilled in the art that many changes and modifications may be made without departing from the spirit and scope of the invention as defined in the claims.

What is claimed is:

1. A hydraulic control system for excavators comprising:

a fluid reservoir;

a variable displacement pump in communication with the fluid reservoir for producing a pressurized working fluid;

a hydraulic actuator having first and second fluid ports through which the working fluid flows into and out of the hydraulic actuator; and a flow control valve including a valve body and a valve spool slidably fitted to the valve body, the valve body having first and second control pressure chambers, each adapted to apply the pressure of the working fluid to first and second ends of the valve spool;

wherein the valve spool is shiftable with respect to the valve body between a first operative position with the first control pressure chamber in communication with the pump and the first fluid port of the actuator and with the second control pressure chamber in communication with the reservoir and the second fluid port of the actuator, a second operative position with the first control pressure chamber in communication with the reservoir and the first fluid port of the actuator and with the second control pressure chamber in communication with the pump and the second fluid port of the actuator, and a neutral position wherein the first and the second control pressure chambers are disconnected from the actuator and connected in common with the reservoir.

2. The hydraulic control system for excavators as recited in claim 1, wherein the flow control valve further includes means for throttling the working fluid as it is drained from the actuator into the reservoir while the valve spool remains in the first or second operative position.

3. The hydraulic control system for excavators as recited in claim 2, wherein the throttling means is positioned on the valve spool such that the working fluid is first delivered to the first or second control pressure chamber and then throttled in advance of drainage into the reservoir.

4. The hydraulic control system for excavators as recited in claim 2, wherein the throttling means is positioned on the valve spool such that the working fluid is first throttled and then delivered to the first or second control pressure chamber and the reservoir.

5. The hydraulic control system for excavators as recited in claim 1, wherein the hydraulic actuator comprises a hydraulic swing motor rotatingly driven by the working fluid in one of a forward direction and a reverse direction.

6. The hydraulic control system for excavators as recited in claim 5, wherein the valve body of the flow control valve is further provided with first and second pilot chambers for applying pilot pressure to the first end and the second end of the valve spool, respectively, and further comprising means for supplying pilot fluid of a controlled pressure to the respective one of the first and the second pilot chambers.

7. The hydraulic control system for excavators as recited in claim 6, wherein the pilot fluid supplying means comprises an electronic proportional control valve for controlling the pressure of the pilot fluid.

* * * * *